United States Patent [19]

Maschke

[11] Patent Number: 4,763,003

[45] Date of Patent: Aug. 9, 1988

[54] METHOD AND APPARATUS FOR CORRECTING HIGH-ORDER ABBERATIONS IN PARTICLE BEAMS

[75] Inventor: Alfred W. Maschke, Torrance, Calif.

[73] Assignee: TRW Inc., Redondo Beach, Calif.

[21] Appl. No.: 15,208

[22] Filed: Feb. 17, 1987

[51] Int. Cl.[4] ..... H01J 3/12

[52] U.S. Cl. ..... 250/396 R; 313/437

[58] Field of Search ..... 250/396; 313/437, 361.1

[56] References Cited

U.S. PATENT DOCUMENTS

| | | | |
|---|---|---|---|
| 3,209,147 | 9/1965 | Dupouy et al. | 250/396 R |
| 3,912,930 | 10/1975 | Creedon et al. | 250/396 R |
| 4,486,664 | 12/1984 | Wollnik | 250/396 R |

*Primary Examiner*—Craig E. Church
*Assistant Examiner*—Jack I. Berman
*Attorney, Agent, or Firm*—Noel F. Heal; Thomas N. Giaccherini

[57] ABSTRACT

A technique for correcting spherical and other aberrations in a particle beam. Spherical aberration is caused by variations in beam behavior dependent on the cube of the radius or radial position with respect to the beam axis. To correct for such aberration, the beam is passed through multiple compensation electric field arrays, each of which has multiple rows of parallel wires stretched transversely across the beam path, the rows being biased with separate voltages to provide an electric field that varies in proportion to the cube of the distance from the central row of the array. The multiple arrays provide a cylindrically symmetrical electric field, and are oriented at a uniform angular spacing, which, for spherical aberration, is 120 degrees.

7 Claims, 1 Drawing Sheet

METHOD AND APPARATUS FOR CORRECTING HIGH-ORDER ABBERATIONS IN PARTICLE BEAMS

BACKGROUND OF THE INVENTION

This invention relates generally to techniques for correcting aberrations in particle beams and, more particularly, to a technique for correcting high-order aberrations, such as spherical aberration. In optical systems, the conventional analysis of image formation and beam focusing is based on "first-order" theory, otherwise known as Gaussian optics or paraxial theory. The basic assumption in first-order theory is that the light rays being traced through various optical elements are close to and parallel with the optical axis of the elements.

When there is a significant departure from this assumption, the optical images formed by the system contain aberrations referred to as high-order aberrations. One of these is called spherical aberration, in which the effect on a focused image, for example, will depend on the cube of the radial distance of the ray from the optical axis. In the case of a convex lens focusing a collimated light beam, the effect of spherical aberration is to focus the outer rays of the beam closer to the lens than the inner rays close to the axis. In effect, the focal point is blurred into a line along the axis. Other high-order aberrations are caused by effects dependent on the fifth power of the radius, or of other odd-numbered powers.

These optical aberrations have counterparts in the field of particle beams. Spherical aberration in particle beam systems results principally from the end fields of the lenses employed, that is from magnetic fields associated with the ends of focusing magnetic coils, which are usually quadrupoles. There also appears to be an $r^3$-dependent space charge effect resulting from mutual repulsion of the like charges of beam particles. Optical systems can be corrected for spherical aberration, at least to some degree, by the use of aspherical lens surfaces, but this option is not available to the designer of particle beam systems.

The angular divergence produced by spherical aberration from a point source at the focal point of a lens of focal length F and radius R is given by:

$$\Delta\theta_{abr} = k\frac{r^3}{R^2F}$$

where r is the beam radius at the output of the lens and k is a dimensionless constant for any particular case.

It has been theorized by D. Scherzer that these aberrations cannot be corrected without introducing either currents or electrical charges into the region occupied by the beam. This is known as Scherzer's Theorem (Z. Phys. 101, p. 593 (1936)). Although the validity of Scherzer's Theorem is currently in doubt, there is still a need for some way to correct spherical and other high-order aberrations in charged particle beams. The present invention addresses this need.

SUMMARY OF THE INVENTION

The present invention resides in apparatus, and a related method, for correcting for high-order aberrations in a particle beam by exposing the beam to an electric field that varies in proportion to a selected power of the radial distance from the axis of the beam. For the correction of aberration of the spherical type, the electric field varies as the cube of the radial distance, and is cylindrically symmetrical.

Briefly, and in general terms, the apparatus of the invention includes a plurality m of compensating electric field arrays positioned to permit the particle beam to pass serially through the arrays, and angularly oriented at locations $2\pi/m$ apart, where m is the order of the aberration to be corrected. Each of the compensating electric field arrays includes a plurality of parallel conductive wires stretched transversely across the path of the beam, the wires being arranged in rows such that all the wires in any row are the same distance from a central axis of the beam, and each of the compensating electric field arrays also includes means for applying a voltage to each row of wires such that the electric field strength at any point in the array is proportional to the mth power of the distance from the point to the central row of wires. The arrangement of m such arrays results in a cylindrically symmetrical electric field that is proportional to the mth power of the radial distance from the central axis.

In one embodiment of the invention, the apparatus is for correcting spherical aberration, m is 3, and the arrays are 120 degrees apart.

In terms of a method, the invention includes the steps of passing the beam through a first compensating electric field array having a plurality of rows of parallel wires disposed transverse to the beam, determining the amount of aberration to be corrected, applying voltages to the rows of wires such that the electric field created by the applied voltages has an intensity proportional to the mth power of the distance from the center row of the array, where m is the order of the aberration. The electric field is also proportional to the amount of aberration to be corrected. The method further includes the step of passing the beam through additional compensating electric field arrays similar to the first but angularly spaced by 360/m degrees, where m is the order of the aberration, and applying similar voltages to the additional arrays to provide a cylindrically symmetrical electric field. If the aberration to be corrected is spherical, m is 3, and the arrays are 120 degrees apart.

It will be appreciated from the foregoing that the present invention represents a significant advance in the field of charged particle beam systems. In particular, the invention provides a technique for corrrecting spherical and higher-order aberrations in charged particle beams. Other aspects and advantages of the invention will become apparent from the following more detailed description, taken in conjunction with the accompanying drawings.

DESCRIPTION OF THE PREFERRED EMBODIMENT

Figure 1:
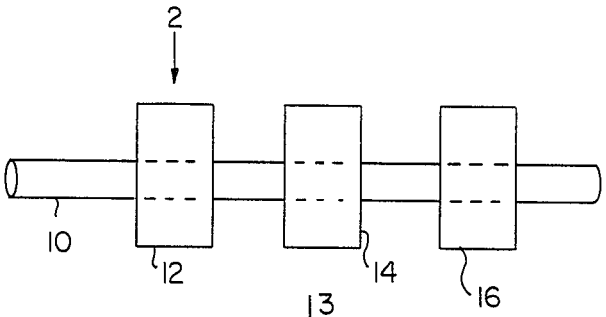
FIG. 1 is a diagrammatic view of a set of three compensating arrays for correcting spherical aberration in a particle beam.

As shown in the drawings for purposes of illustration, the present invention is concerned with correcting high-order aberrations in particle beams. If not corrected, spherical aberration arising in the focusing lens of a particle beam, or arising from space charge or other effects, results in unwanted beam divergence. There does not appear to have been any effective solution to this problem prior to the invention.

In accordance with the invention, the beam is exposed to an electric field that is cylindrically symmetrical, has a zero field strength at the axis of the beam, and increases in proportion to a selected power of the radial distance from the axis. If the third power is selected, the electric field applies a compensating deflection force proportional to the cube of the radius, and thereby compensates for the effects of spherical aberration.

FIG. 1 shows a charged beam, indicated by reference numeral 10, passing through a sequence of three compensating arrays 12, 14 and 16, which together provide the cylindrically symmetrical electric field to compensate for spherical aberration. Each of the arrays 12, 14 and 16 consists of conductive wires 18 arranged in a parallel relationship across the beam path. The direction of the wires is transverse to the beam direction, and the array extends in two orthogonal directions. That is to say, there are multiple rows of wires. As viewed in a direction parallel to the wires (FIG. 2), each row has multiple wires at the same radial spacing with respect to a row positioned on the central axis.

Figure 2:
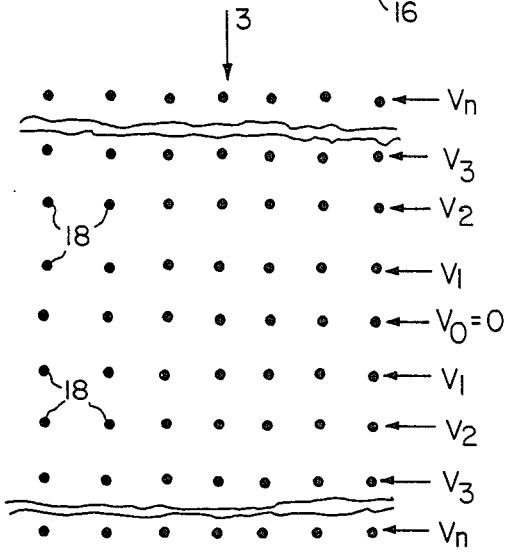
FIG. 2 is a plan view of one of the compensating arrays of FIG. 1, taken in the direction of the arrow 2.

The same voltage is applied to all wires in a row, i.e. to all wires at the same distance from the central row. The voltages are selected to provide an electric field that is substantially proportional to mth power of the distance from the central row. The voltage applied to the central row is zero, and the voltages applied to successive rows as the radial distance increases is of successively greater values, such that the field between any two adjacent rows will be proportional to the cube of the radial distance. As indicated in FIG. 2, the voltage applied to the central row is $v_0$ (=0) and the voltages applied to successive rows in one direction are $v_1$, $v_2$, $v_3$, and so forth, while the voltages applied to successive rows in the opposite direction are also $v_1$, $v_2$, $v_3$, and so forth. The absolute value of the voltages applied to the arrays is also scaled to be proportional to the anticipated aberration experienced by the beam. This may be determined experimentally, or may, in some applications, be a variable signal derived from a lens system and indicative of the degree of aberration.

A close approximation of the $r^3$ dependence of the electric field can be obtained by applying a voltage proportional to $n^4$ to the nth row of wires from the central axis. The electric field between the nth and (n+1)th rows is then $(n+1)^4-n^4$. Expansion of this expression results in cancellation of the $n^4$ terms and, especially for large values of n, leaves a predominant term proportional to $n^3$.

The use of arrays of thin wires to impose a desired electric field on the beam meets the necessary requirement that no significant fraction of the beam is intercepted by the array. Any heating effects are minimized because of the large ratio of surface area to volume, and any distortion due to heating is minimized by stretching the wires.

Figure 3:
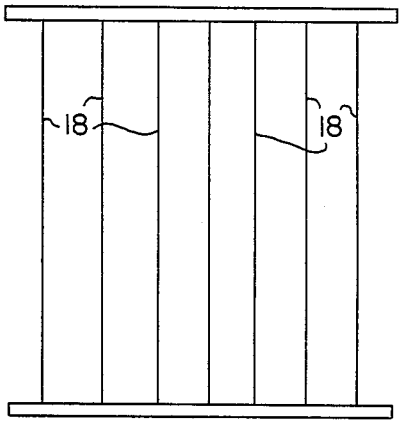
FIG. 3 is an elevational view of the same array as FIG. 2, taken in the direction of the arrow 3 in FIG. 2.

The array as shown in FIGS. 2 and 3 provides an electric field in only one transverse direction. For cylindrical symmetry in correcting aberration of the spherical type, three separate arrays are employed, oriented 120 degrees apart. This arrangement produces perfect cylindrical symmetry because of the following trigonometric relationship:

$$\sum_{i=1}^{m} \cos^{m+1}\left[\theta + \frac{2\pi i}{m}\right] = F(m),$$

where $\theta$ is the azimuth angle, m is the order of the aberration (3 for spherical), and F(m) is a function of m (only). Thus the effect of this relationship is that the expression for the sum of the effects of the multiple electric field arrays reduces to a function of m, which is independent of the azimuth angle. The electric field created by the m arrays is, therefore, cylindrically symmetrical about the axis of the beam.

It will be appreciated from the foregoing that the present invention represents a significant advance in the field of particle beam technology. In particular, the invention provides a simple way of applying a corrective deflection force to the beam particles in proportion to a selected odd-numbered power of the radial distance of the particles from the central axis. The technique can be used to compensate for spherical and higher orders of aberration. It will also be appreciated that, although an embodiment of the invention has been described in detail for purposes of illustration, various modifications may be made without departing from the spirit and scope of the invention. For example, the embodiment described for correcting spherical aberration can be readily modified to correct $r^5$-dependent aberration, using five arrays angularly spaced by 72-degree

I claim:

1. Apparatus for correcting a particle beam for spherical or higher-order aberration, the apparatus comprising:

a plurality m of compensating electric field arrays positioned to permit the particle beam to pass serially through the arrays, and angularly oriented at locations $2\pi/m$ radians apart, where m is the order of the aberration to be corrected;

wherein each of the compensating electric field arrays includes a plurality of parallel conductive wires stretched transversely across the path of the beam, the wires being arranged in rows such that all the wires in any row are the same distance from a central axis of the beam, and wherein each of the compensating electric field arrays also includes means for applying a voltage to each row of wires such that the electric field strength at any point in the array is proportional to the mth power of the distance between the point and the central row of wires, and wherein the arrangement of m such arrays results in a cylindrically symmetrical electric field that is proportional to the mth power of the radial distance from the central axis.

2. Apparatus as defined in claim 1, wherein:

the apparatus is for correcting spherical aberration, m is 3, and the arrays are 120 degrees apart.

3. Apparatus as defined in claim 2, wherein:

the rows of wires in each of the compensating electric field arrays are uniformly spaced;

the voltage applied to the nth row of wires from the center of the array is proportional to the fourth power of n.

4. A method for correcting high-order aberrations in particle beams, comprising the steps of:

passing the beam through a first compensating electric field array having a plurality of rows of parallel wires disposed transverse to the beam;

determining the amount of aberration to be corrected;

applying voltages to the rows of wires such that the electric field created by the applied voltages has an intensity proportional to the mth power of the distance from the center row of the array, where m is the order of the aberration, and proportional to the amount of aberration to be corrected;

passing the beam through additional compensating electric field arrays similar to the first but angularly spaced by 360/m degrees; and applying similar voltages to the additional arrays to provide a cylindrically symmetrical electric field.

5. A method as defined in claim 4, wherein:

the method is for correcting spherical aberration, m is 3, and the arrays are 120 degrees apart.

6. A method as defined in claim 5, wherein:

each array has a plurality of rows of parallel wires oriented transversely with respect to the beam direction;

the steps of applying voltages to the arrays are performed by applying separate voltages to the separate rows of wires.

7. A method as defined in claim 6, wherein:

the rows of wires in each of the compensating electric field arrays are uniformly spaced;

the voltage applied to the nth row of wires from the center of the array is proportional to the fourth power of n.

* * * * *